US006370771B1

(12) United States Patent
Huang

(10) Patent No.: US 6,370,771 B1
(45) Date of Patent: Apr. 16, 2002

(54) METHOD FOR MAKING AN ELECTRICAL CONNECTOR

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/549,489

(22) Filed: Apr. 14, 2000

Related U.S. Application Data

(63) Continuation of application No. 09/182,755, filed on Oct. 29, 1998.

(51) Int. Cl.[7] ..... H01R 43/00

(52) U.S. Cl. ..... 29/883; 29/889; 29/879; 439/404

(58) Field of Search ..... 29/883, 884, 874; 439/404

(56) References Cited

U.S. PATENT DOCUMENTS 5,074,039 A * 12/1991 Hillbish et al. ..... 29/883
5,201,883 A * 4/1993 Atoh et al. ..... 29/883
5,761,805 A * 6/1998 Guyer ..... 29/883
5,926,952 A * 7/1999 Ito ..... 29/883
6,219,913 B1 * 4/2001 Uchiyama ..... 29/883
6,269,539 B1 * 8/2001 Takahashi et al. ..... 29/883

* cited by examiner

*Primary Examiner*—Carl J. Arbes
(74) *Attorney, Agent, or Firm*—Wei Te Chung

(57) ABSTRACT

Method for making an electrical connector, comprising the following steps. Step 1: defining first carrier and first terminal sections along a first material sheet. Step 2: defining at least a first pilot hole on the first carrier section and at least two first terminals on the first terminal section. Each first terminal has a body portion extending between front and rear contact portions. Step 3: forming a first bridging rib around the first terminals aligned by the first carrier section through a first inserting mold. Step 4: making a second insert molding around the body portions of the terminals supportably aligned by the associated first bridging rib.

10 Claims, 7 Drawing Sheets

METHOD FOR MAKING AN ELECTRICAL CONNECTOR

This application is a continuation application of the copending application of Ser. No. 09/182,755 filed Oct. 29, 1998.

FIELD OF THE INVENTION

The present invention relates to a method for making an electrical connector by means of insert molding.

DESCRIPTION OF PRIOR ART

Electrical connectors made by insert molding feature high precision, reliability, and low labor cost. For example, very high density cable interconnect (VHDCI) connectors with a small pitch of 0.8 mm are made by insert molding. However, during the molding process each terminal must be accurately positioned and suspended within a mold cavity without any positional variation under high a injection of molten plastic. Conventionally, dowel pins are assembled to the mold cavity to position and support terminals. However, this increases manufacturing costs and complicates the configuration of the mold cavity as well as maintenance thereof. For example, a typical Ultra SCSI plug connector includes 68 terminals and the corresponding mold cavity requires 68 dowel pins to support the terminals. Additionally, the terminals are arranged in parallel in two different rows. When the dowel pin is to support the corresponding upper terminal, the corresponding lower terminal provides an offset portion to allow the dowel pin to pass therebetween. Furthermore, the dowel pins rooted within the mold cavity hinder the flow of molten plastic therein, thus shapes of the terminals must be modified to reduce this impact. If a dowel pin is inadvertently removed from the cavity, the corresponding terminal loses its support and alignment resulting in an inappropriate or defective portion thereof. U.S. Pat. No. 5,761,805 issued to Guyer on Jun. 9, 1998 describes such a suggestion.

SUMMARY OF THE INVENTION

An objective of this invention is to provide a method for making an electrical connector by means of insert molding wherein alignment of terminals within a mold cavity is achieved by portions of the terminals.

In order to achieve the objective set forth, a method for making an electrical connector comprises the steps of 1) Defining first carrier and first terminal sections along a first material sheet. 2) Defining at least a first pilot hole on the first carrier section and at least first and second terminals alternately arranged on the first terminal section. Each first terminal has a body portion extending between front and rear contact portions. 3) Defining a first terminal core by forming a first bridging rib around the first and second terminals aligned by the first carrier through a first inserting mold. 4) Defining second carrier and second terminal sections along a second material sheet. 5) Defining at least a second pilot hole on the second carrier section and at least third and fourth terminals on the second terminal section. Each terminal has a body portion extending between front and rear contact portions. 6) Defining a second terminal core by forming a second bridging rib around the third and fourth terminals aligned by the second carrier through a second inserting mold. 7) Stacking the first and second terminal cores. 8) Making a third insert molding around the body portions of the first/second terminals and the third/fourth terminals respectively aligned by the first bridging rib and the second bridging rib to finalize the whole connector core.

According to an aspect of the present invention, the rear portions are insulation displacement sections which extend transversely from the body portion.

According to another aspect of the present invention, the first and second terminals have different lengths. The front contact portions of the first and second terminals are arranged on a first common plane and the front contact portions of the third and fourth terminal are arranged on a second common plane parallel to the first common plane.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENTS

Figure 1A:
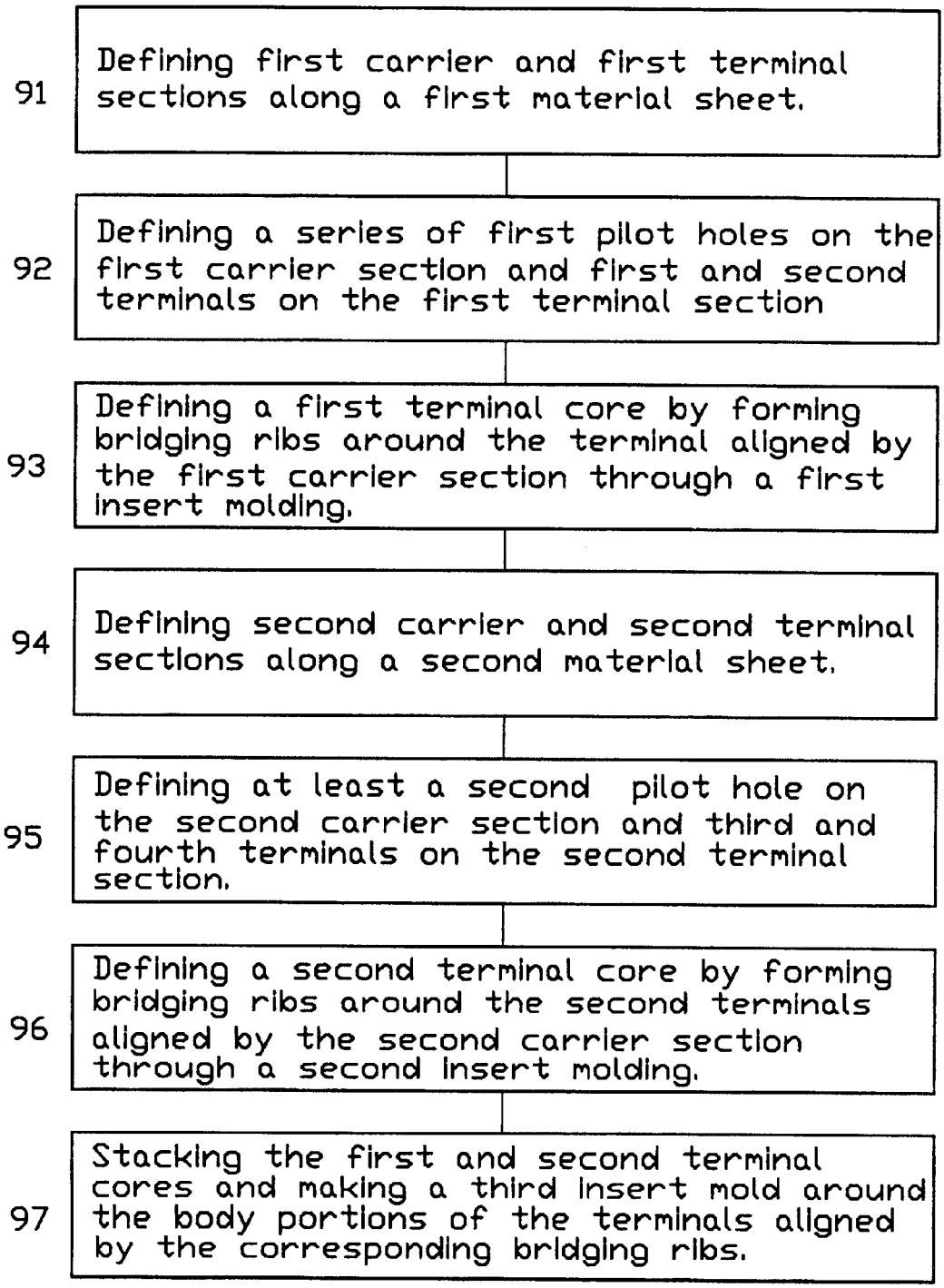
FIG. 1A is a flow chart of a manufacturing process for an electrical connector in accordance with a presently preferred embodiment of the present invention.
Figure 1B:
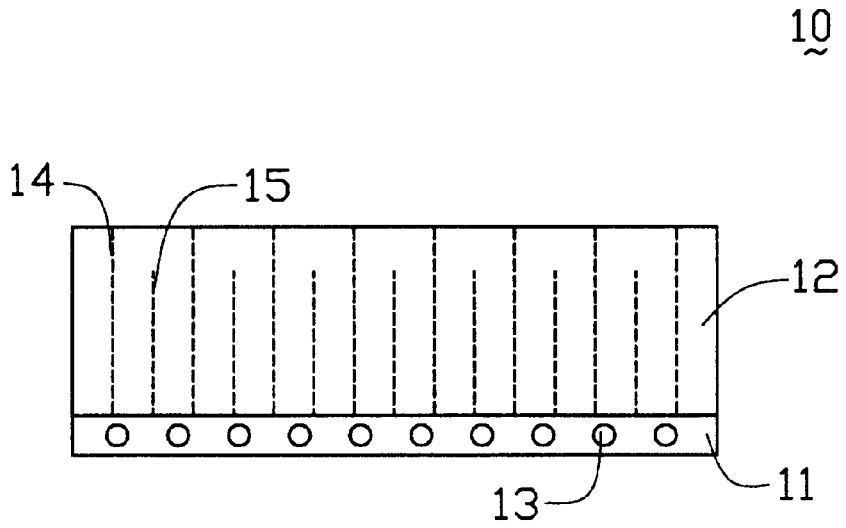
FIG. 1B shows first and second terminals being formed from a first material sheet.
Figure 1C:
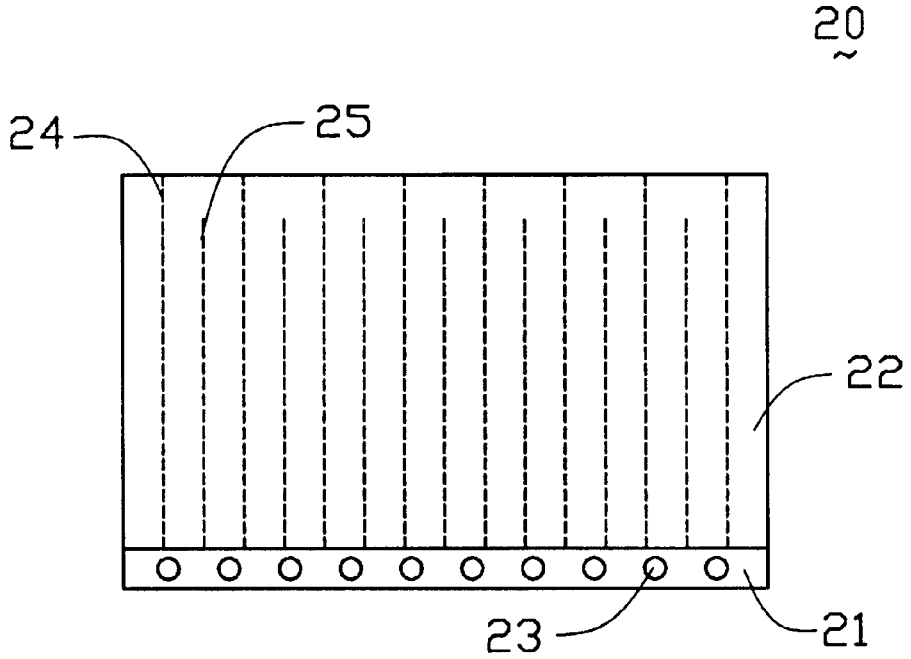
FIG. 1C shows third and fourth terminals being formed from a second material sheet.

Referring to FIGS. 1A to 1C, and 2A to 2D, a method for making an electrical connector core in accordance with the present invention comprises the following steps. Step 91: defining a first carrier section 11 and first terminal section 12 along a first material sheet 10. Step 92: defining at least a first pilot hole 13 on the first carrier section 11 and at least first and second terminals 14, 15 alternatively arranged on the first terminal section 12. Each first terminal 14 or second terminal 15 has a body portion 14*a* (ISa) extending between front and rear contact portions 14*b*, 14*c* (15*b*, 15*c*) thereof. The terminals 14, 15 have different lengths. Step 93: forming first bridging ribs 17, 18 around the terminals 14, 15 aligned by the first carrier section 11 through a first inserting mold 40 (FIG. 3A). The bridging rib 17 is located on the body portions 14*a*, 15*a*, while the bridging rib 18 is located on the rear portions 14*c*, 15*c* which are insulation displacement sections in this embodiment. The insulation displacement sections 14*c*, 15*c* extend transversely from the body portions 14*a*, 15*a*. The terminals 14, 15 bridged by the bridging ribs 17, 18 are referred to as a first terminal core 10*a* for easy description and better understanding.

Figure 3A:
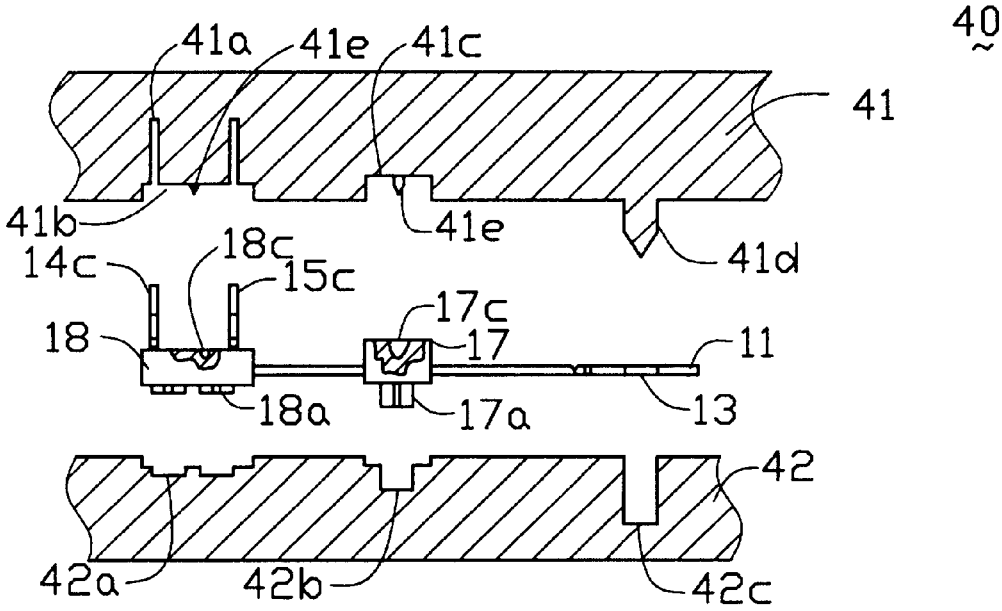
FIG. 3A is a cross sectional view of a first mold for forming the first terminal core of the connector.
Figure 3B:
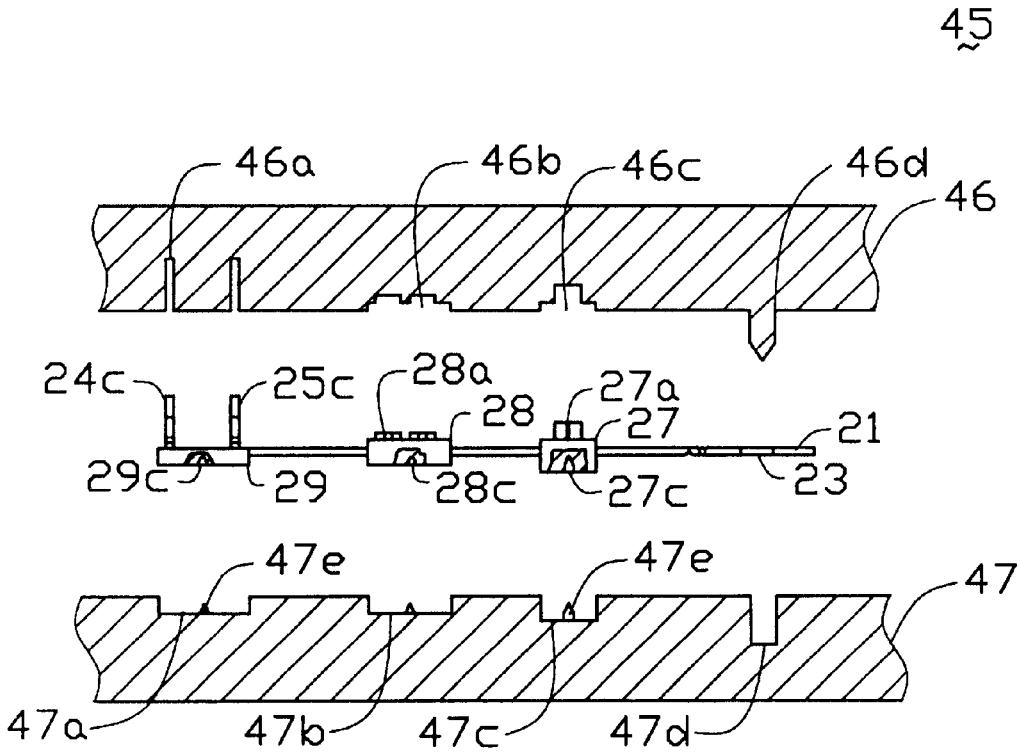
FIG. 3B is a cross sectional view of a second mold for forming the second terminal core of the connector.

Step 94: defining a second carrier section 21 and second terminal section 22 along a second material sheet 20. Step 95: defining at least a second pilot hole 23 on the second carrier section 21 and at least third and fourth terminals 24, 25 on the second terminal section 22. Each terminal 24 (25) has a body portion 24*a* (25*a*) extending around front and rear contact portions 24*b*, 24*c* (25*b*, 25*c*) thereof. The terminals 24, 25 have different lengths and are longer than the terminals 14, 15. Step 96: forming second bridging ribs 27, 28, 29 around the terminals 24, 25 aligned by the second carrier section 21 through a second inserting mold (FIG. 3B). The bridging rib 27 is located adjacent to the front portions 24*b*, 25*b*, and the bridging rib 28 is located on the body portions 24*a*, 25*a*, while the bridging rib 29 is located on the rear portions 24*c*, 25*c* which are insulation displacement sections. The insulation displacement sections 24*c*, 25*c* extend transversely from the body portions 24*a*, 25*a*. The terminals 24, 25 bridged by the bridging ribs 27, 28, 29 are referred to as a second terminal core 20*a*.

Figure 2A:
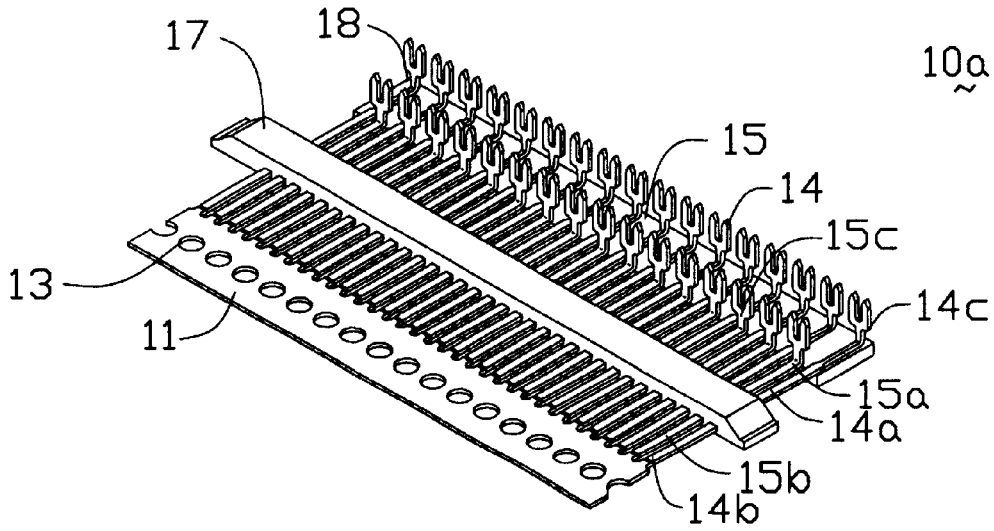
FIG. 2A is a perspective view of a first terminal core of the connector with the first carrier section attached thereto.
Figure 2B:
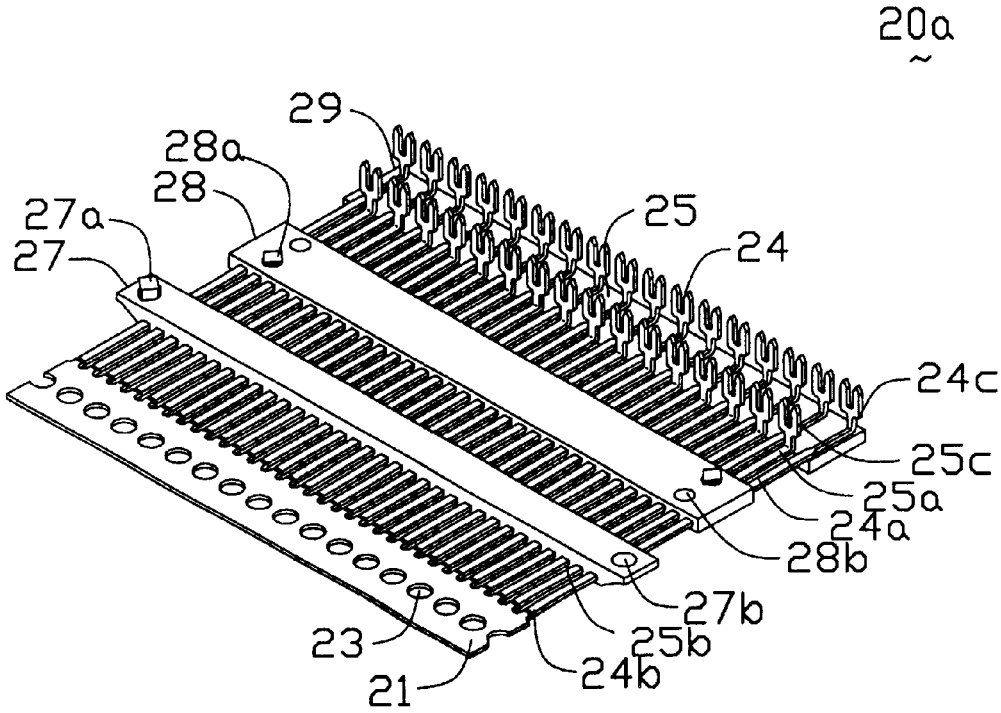
FIG. 2B is a perspective view of a second terminal core of the connector with the second carrier section attached thereto.
Figure 2C:
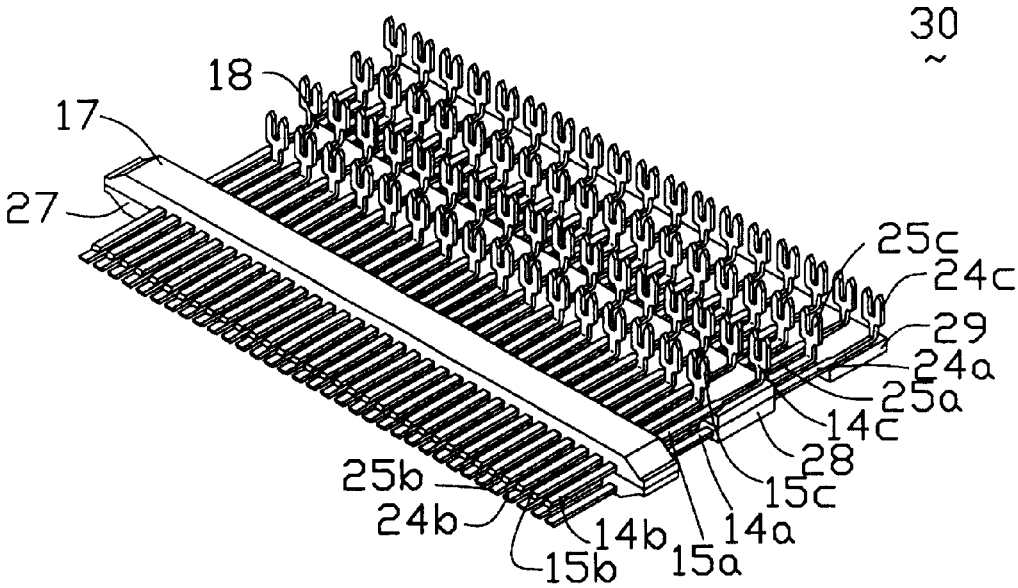
FIG. 2C is a perspective view of a terminal core assembly of the connector.
Figure 2D:
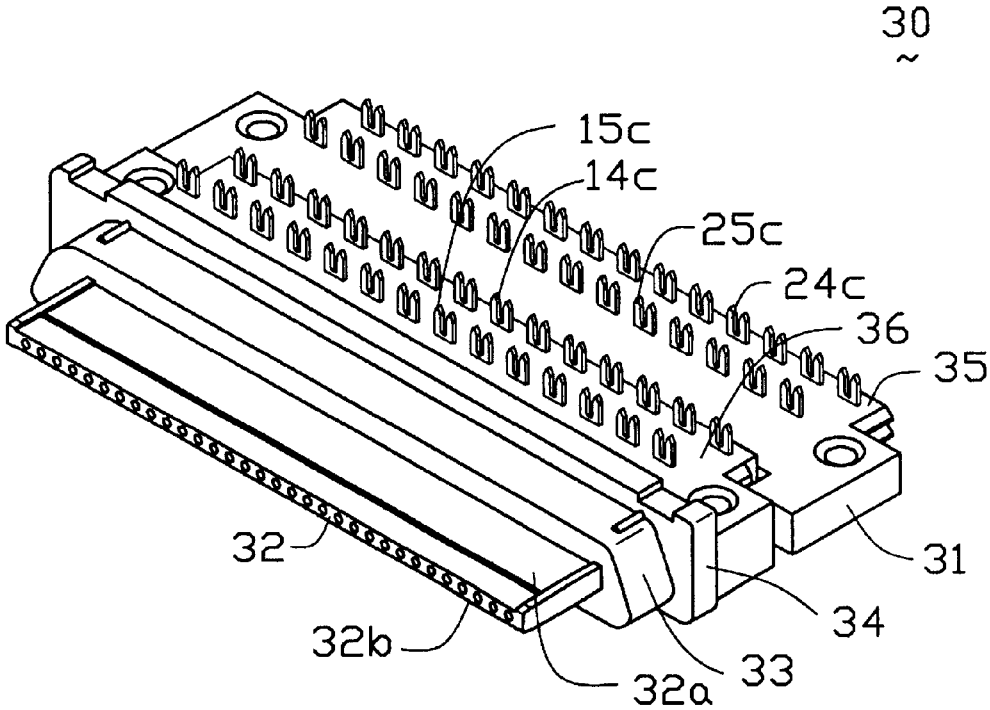
FIG. 2D is a first connector core formed from enclosing the first terminal core assembly with a housing.

Step 97: stacking and assembling the terminal cores 10*a*, 20*a* to form a terminal core assembly 30, as shown in FIG. 2C. In order to facilitate assembly between the terminal cores 10*a*, 20*a*, the bridging ribs 27 and 28 are integrally formed with pins 27*a* and 28*a*, (FIGS. 2B and 3B) and defined with recesses 27*b*, 28*b* (FIGS. 2B and 3B), and the bridging ribs 17 and 18 are integrally formed with pins 17*a* and 18*a* (FIGS. 2B and 3A) and defined with recesses (not shown). When the terminal cores 10*a*, 20*a* are assembled, the pin 27*a* of the bridging rib 27 is securely received within the corresponding recess (not shown) of the bridging rib 17, while the pin 17*a* of the bridging rib 17 is securely received within the recess 27*b* of the bridging rib 27. In addition, the pins 28*a* of the bridging rib 28 are securely received within the corresponding recesses (not shown) of the bridging rib 18, while the pins 18*a* of the bridging rib 18 are securely received within the corresponding recesses 28*b* of the bridging rib 28.

After the terminal cores 10*a*, 20*a* are assembled, the front contact portions 14*b*, 15*b* are located in a first common plane and the front contact portions 24*b*, 25*b* are located in a second common plane which is parallel to the first common plane. Additionally, the insulation displacement sections 14*c*, 15*c*, 24*c*, 25*c* are axially staggered in four rows and the conductive wires (not shown) can be electrically terminated on the insulation displacement sections 14*c*, 15*c*, 24*c*, 25*c*. Furthermore, the insulation displacement sections 14*c*, 15*c* are located in a third common plane 36 (FIG. 4B), while the insulation displacement sections 24*c*, 25*c* are located in a fourth common plane 35 (FIG. 4B) parallel to the third common plane 36. By this arrangement, the insulation displacement sections 24*c*, 25*c* will not hinder the conductive wires connected to the insulation displacement sections 14*c*, 15*c*.

Step 98: making a third insert molding around the terminal core assembly 30 whereby the body portions 14*a*, 15*a*, 24*a*, 25*a* are enclosed with a housing 31. In the third insert molding, the body portions 14*a*, 15*a*, 24*a*, 25*a* of the terminals 14, 15, 24, 25 are all pre-aligned by the associated bridging ribs 17, 18, 27, 28. This simplifies the whole manufacturing process and details will be described according to FIGS. 2D and 4B. The housing 31 includes a tongue 32 on which the front contact portions 14*b*, 15*b* are located on an upper face 32*a* thereof, while the front contact portions 24*b*, 25*b* are located on a bottom face 32*b* thereof. The tongue 32 can mate with a receptacle connector (not shown). The housing 31 includes a D-shape shoulder 33 which receives with a D-shaped shroud of an EMI bracket (not shown) for eliminating EMI interference. The housing 31 includes a plate 34 which serves as a positioning device within the EMI bracket. The housing 31 defines a first mating plane 36 on which the insulation displacement sections 14*c*, 15*c* are located and a second mating plane 35 on which the insulation displacement sections 24*c*, 25*c* are located.

Now referring to FIG. 3A, the first mold 40 is used to form the bridging ribs 17, 18 on the body portions 14*a*, 15*a* of the terminals 14, 15. An upper mold 41 includes a pair of slots 41*a* for receiving the insulation displacement sections 14*c*, 15*c* and cavities 41*b*, 41*c* for forming the bridging ribs 17, 18. The upper mold 41 farther includes alignment pins 41 d which extend through the corresponding first pilot holes 13 of the first carrier 11. The upper mold 41 further includes dowel pins 41*e* which define pin holes 17*c*, 18*c* on the corresponding bridging ribs 17, 18. A lower mold 42 defines cavities 42*a*, 42*b* for forming the pins 18*a*, 17*a*. The lower mold 42 defines a pinhole 42*c* for receiving the alignment pin 41*d* therein. Thus, the terminals 14, 15 can be securely supported between the upper and lower molds 41, 42. By this arrangement, after the bridging ribs 17, 18 are formed on the body portions 14*a*, 15*a*, the terminals 14, 15 can be bridged together with precise alignment by means of them first carrier section 11.

Now referring to FIG. 3B, a second mold 45 is used to form the bridging ribs 27, 28, 29 on the body portions 24*a*, 25*a* of the terminals 24, 25. An upper mold 46 includes a pair of slots 46*a* for receiving the insulation displacement sections 24*c*, 25*c* and cavities 46*b*, 46*c* for forming portions of the bridging ribs 27, 28, 29. The upper mold 46 further includes alignment pins 46*d* which extend through the corresponding first pilot hole 23 of the first carrier 21. A lower mold 47 defines cavities 47*a*, 47*b*, 47*c* for forming the bridging ribs 27, 28, 29. The lower mold 47 defines pinholes 47*d* for receiving the alignment pin 46*d* therein. Thus, the terminals 24, 25 are securely supported between the upper and lower molds 41, 42. By this arrangement, after the bridging ribs 27, 28, 29 are formed on the body portions 24*a*, 25*a*, and the terminals 24, 25 can be bridged together with precise alignment by means of the second carrier section 21. The lower mold 47 further includes dowel pins 47e which define pinholes 27*c*, 28*c*, 29*c* on the corresponding bridging ribs 27, 28 and 29.

Figure 3C:
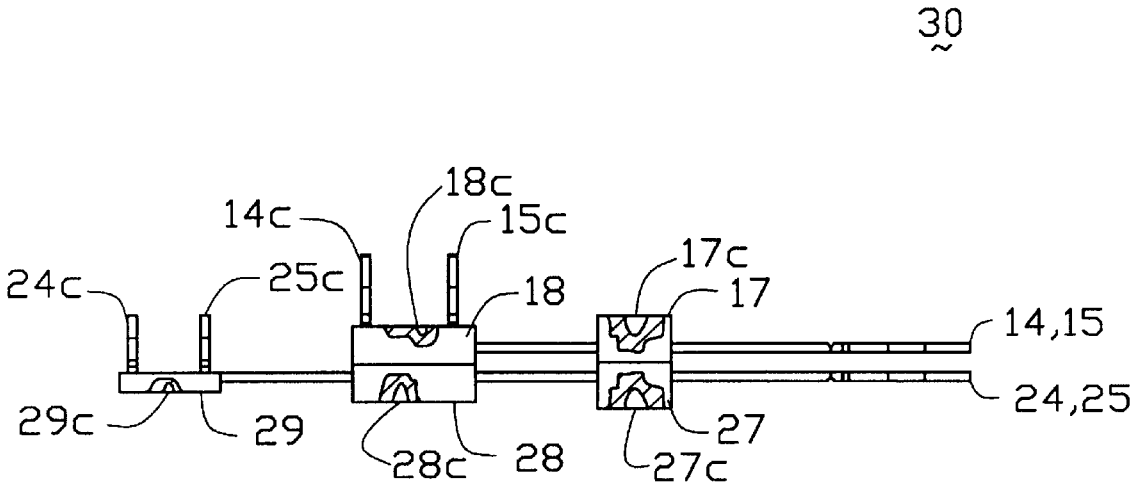
FIG. 3C is a side elevational view of the terminal core assembly.
Figure 4A:
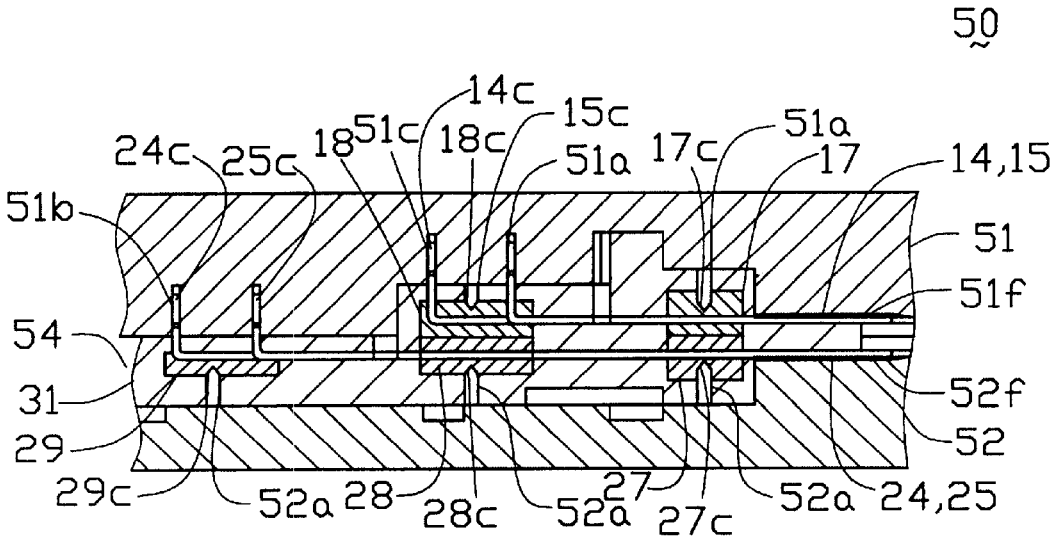
FIG. 4A is a cross sectional view of a third mold for forming the housing around the first terminal core assembly.
Figure 4B:
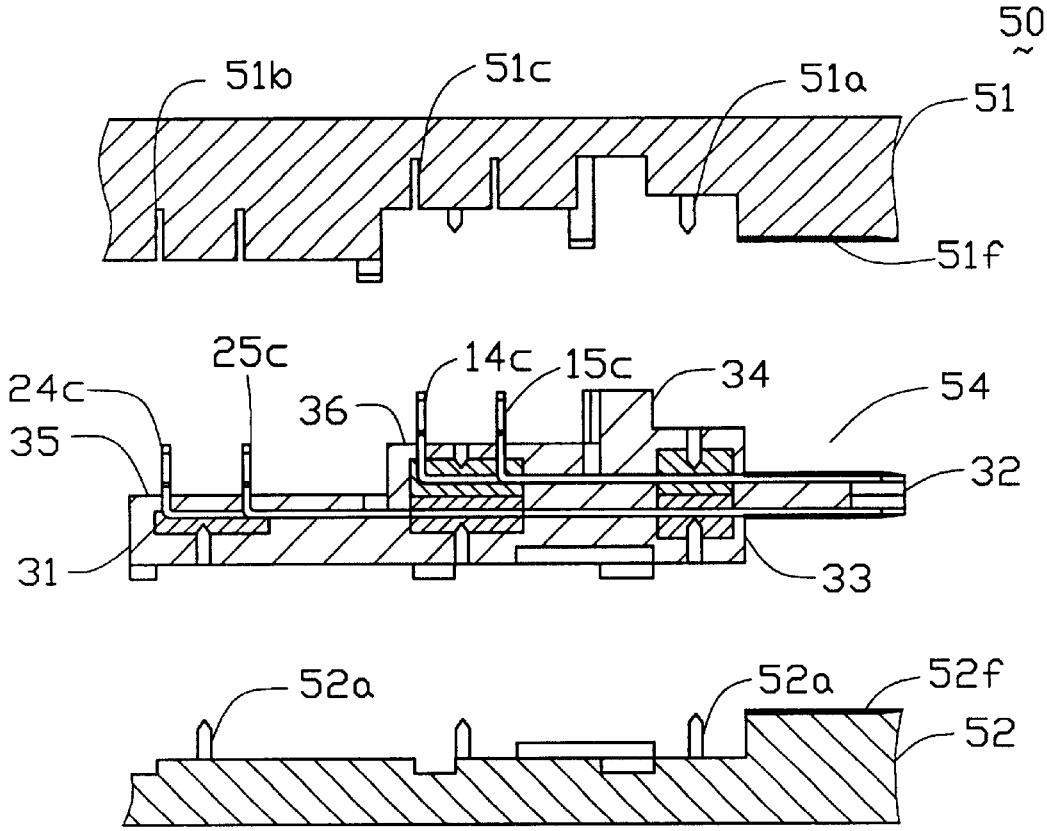
FIG. 4B is similar to FIG. 4A wherein the connector core assembly is removed from the third mold.

The terminal core assembly 30 shown in FIG. 3C is then disposed within a third mold 50 for enclosing the housing 31 over the assembly 30 thereby forming a connector core 54. Referring to FIG. 4A, the third mold 50 includes an upper mold 51 and a lower mold 52 mated with the upper mold 51. The upper and lower molds 51, 52 jointly define a mold cavity (not labeled) corresponding to the outer shape of the housing 31. The upper mold 51 defines two pairs of slots 51*b*, 51*c* for receiving the insulation displacement sections 24*c*, 25*c*, 14*c*, 15*c*, respectively. The insulation displacement sections 24*c*, 25*c* may serve as an auxiliary alignment device, other than the bridging ribs 17, 18, 27 and 28, in enclosing the housing 31 over the terminal core assembly 30. The first and second carriers 11, 21 are removed after the first and second terminal cores 10*a*, 20*a* are assembled. However, because spatial relations between terminals 14, 15, 24, 25 have been set by the main alignment device, i.e., the bridging ribs 17, 18, 27, 28, 29, the terminals 14, 15, 24, 25 do not require any support like the prior art. Alternatively, the lower mold 52 forms supporting pins 52*a* which mate with the pinholes 27*c*, 28*c*, 29*c*. The upper mold 51 forms support pins 51*a* which mate the pinholes 17*c*, 18*c*. By this arrangement, terminals 14, 15, 24, 25 are precisely suspended within the mold cavity and the relationship therebetween is secured. Furthermore, the upper and lower molds 51, 52 define alignment slots 51*f*, 52*f* corresponding to the front contact portions 14*b*, 15*b*, 24*b*, 25*b* which are securely received therein. After the terminal core assembly 30 is enclosed by the housing 31, the upper and lower molds 51, 52 are separated to remove the connector core 54 which is further enclosed with the EMI bracket (not shown) for later processing to the final complete connector, as seen in FIG. 4B.

The feature of the invention is to provide an intermediate or semi-finished product during the manufacturing so as to simplify the procedure without using a plurality of odd dowel pins to support the corresponding terminals during the insert molding process. In other words, in the invention at least a bridging rib is provided to integrate a plurality ofjuxtaposed terminals to form a terminal core at first, and successively the terminal core itself, or combined with other terminal core as a terminal core assembly, can be finalized through an insert molding procedure to a connector core for further assembling.

It should be noted that during the-initial insert molding stage, the carrier section 11, 21 is used as a holding or alignment device to keep the juxtaposed terminals 14(15), 24(25) in spatial aligned positions to form the first terminal core 10*a* and the second terminal core 20*a*. While understandably it is impossible to directly use the carrier section 11(21) as the holding/alignment device for maintaining the terminals in position to form the final product, i.e., the connector core, during only one insert molding process. This is because the terminals are essentially embedded within the housing, around their connection regions with the carrier, of the final connector core product, and thus it is impossible to have the carrier section still attached to the terminals for maintaining alignment of the terminals during insert molding. Additionally, even though in some other type connector cores, it may have terminals with exposed connection regions with the carrier section and allow the carrier section still attached thereto to function as a holding/alignment device for holding the terminal in position during insertion molding, those terminals still requires the dowel pins as disclosed in the aforementioned U.S. Pat. No. 5,761,805 to support them during the insert molding procedure due to their own gravity.

While differently and specially, the invention discloses a new method of making a connector core by replacing one step insert molding with two stages insert molding wherein at the first stage only one section (i.e., the middle portion) of each terminal is integrated with others through an initial insert molding procedure with the carrier section functioning as the holding/alignment device. The reason why the carrier section can perform this function in this situation different from the aforementioned unavailable condition, is that because only a middle section is required with plastic material surrounding, the terminals need not suspend in the air, and instead the front portions and the body portions of the terminals can be directly seated on the mold surface to form the bridging rib on the middle portions without any dowel pins' supporting. Then, successively the terminal core including the bridging rib and the associated terminals may be formed with housing through another insert molding procedure wherein the terminals have been already set with the fixed spatial relation with one another by the bridging rib, and the bridging rib may be directly engaged with the corresponding mold, so as to precisely and easily implement the insert molding process to finalize the end product.

Although in the embodiment, there are two terminal cores fastened together to form a one piece terminal core assembly before the last stage insert molding procedure and each terminal core includes two bridging ribs, the invention can be applied to some other types connector (core) by means of integrating only one row of terminals through an initial insert molding procedure and successively using such only one terminal core with only one bridging rib to implement the final connector (core) through another (i.e., the last) insert molding.

In conclusion, the invention discloses two new matters. The first one is to use a two-stage insert molding procedure instead of the conventional one step insert molding to form a connector or connector core with at least one row of terminals side by side arranged therein. The second one is to provide an intermediate product, i.e., the terminal core or the terminal core assembly, to first integrate the juxtaposed terminals together preferably through an initial insert molding procedure, and successively be formed to the final product through another insert molding procedure.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. A method of making an electrical connector, comprising the steps of:

defining a carrier section and a terminal section along a material, said terminal section including at least one row of terminals side by side arranged with each other;

forming a bridging rib around said terminals supportably aligned in position by said carrier section through an initial insert molding procedure so as to form a unitary terminal core including the bridging rib and the associated row of terminals; and forming a housing around the terminal core through a second insert molding procedure and covering some originally exposed portion of each of said terminals to finalize a connector core which is configured to be adapted to be assembled to an EMI shield for forming a final complete connector.

2. The method as defined in claim 1, wherein the method includes a step of defining a second carrier section and a second terminal section along a second material sheet, and said second terminal section includes at least a second row of terminals side by side arranged one another.

3. The method as defined in claim 2, wherein the method further includes a step of forming a second bridging rib around said second row of terminals aligned in positioned by said second carrier section through another initial insert molding procedure so as to form a unitary section terminal core including the second bridging rib and the associated second row of terminals.

4. The method as defined in claim 3, wherein the method further includes a step of stacking the terminal core and the second terminal core together to be terminal core assembly.

5. The method as defined in claim 4, wherein the housing surrounds the terminal core assembly through said second insert molding procedure to finalize a connector core.

6. The method as defined in claim 5, wherein said terminal assembly includes means for engagement with molds in the second insert molding procedure.

7. The method as defined in claim 1, wherein the method further includes a step of removing the carrier section from the row of terminals before forming the housing.

8. A method of making a connector having at least two rows of terminals through at least two insert molding procedures, comprising the steps of:

defining a first carrier section and a first terminals section along a first material sheet, said first terminal section including a first row of terminals side by side arranged with one another;

forming a first terminal core, through a first insert molding procedure, including a first transverse bridging rib supportably aligning said first terminals in position;

defining a second carrier section and a second terminals section along a second material sheet, said second terminal section including a second row of terminals side by side arranged with one another;

forming a second terminal core, through another first insert molding procedure, including a second transverse bridging rib supportably aligning said second terminals in position;

stacking the first terminal core and the second terminal core together;

forming a housing around the combined stacked first terminal core and second terminal core through a second insert molding procedure.

9. The method as defined in claim 8, wherein before forming the housing, the first carrier section is removed from the first row of terminals and the second carrier section is removed from the second row of terminals.

10. The method as defined in claim 9, wherein during the first insert molding procedure, alignment pins of molds are receiveably engaged within corresponding pivot holes in the first terminal carrier section and in the second terminal carrier section for positioning consideration, while during the second insert molding procedure, dwell pins of molds are receiveably engaged within pin holes in the first transverse bridging rib formed in the first insert molding procedure and in the second transverse bridging rib formed in the first insert molding procedure for positioning consideration.

* * * * *